United States Patent [19]

Mahaffy et al.

[11] 3,972,155

[45] Aug. 3, 1976

[54] PACKAGING TECHNIQUES FOR SEMI-RIGID PACKAGES

[75] Inventors: Reid A. Mahaffy, Montclair; Joel A. Hamilton, Englewood, both of N.J.

[73] Assignee: Mahaffy & Harder Engineering Company, Totowa, N.J.

[22] Filed: Aug. 1, 1973

[21] Appl. No.: 384,717

Related U.S. Application Data

[62] Division of Ser. No. 860,590, Sept. 24, 1969, Pat. No. 3,792,181.

[52] U.S. Cl. ..... 53/30 R; 53/22 A; 53/112 A; 53/184 R; 426/392

[51] Int. Cl.[2] ..... B65B 43/08

[58] Field of Search ..... 426/129, 130, 106, 115, 426/121, 392, 396, 397, 413; 264/90, 92, 93; 53/18, 41, 42, 184, 30, 141, 22 A, 28, 112; 220/60 R; 229/43

[56] References Cited

UNITED STATES PATENTS

| | | | |
|---|---|---|---|
| 1,988,383 | 1/1935 | Hermani | 220/60 R X |
| 2,012,529 | 8/1935 | Eldredge | 426/414 X |
| 2,749,572 | 6/1956 | Nowak | 53/30 UX |
| 3,348,358 | 10/1967 | Sternau | 53/42 |
| 3,392,871 | 7/1968 | Donovan | 220/60 R X |
| 3,470,281 | 9/1969 | Knowles | 264/92 |
| 3,481,100 | 12/1969 | Bergstrom | 53/184 |
| 3,498,018 | 3/1970 | Seiferth | 53/22 R |
| 3,676,159 | 7/1972 | Fallowfield | 220/60 R X |
| 3,695,900 | 10/1972 | Young et al. | 426/129 X |
| 3,754,372 | 8/1973 | Perdue | 53/112 A X |

FOREIGN PATENTS OR APPLICATIONS

| | | | |
|---|---|---|---|
| 1,188,791 | 3/1965 | Germany | 264/90 |

*Primary Examiner*—Steven L. Weinstein
*Attorney, Agent, or Firm*—Parmelee, Johnson & Bollinger

[57] ABSTRACT

A method for packaging is disclosed including forming a semi-rigid plastic sheet into a receptacle, filling the formed receptacle with the product to be packaged and forming a semi-rigid plastic sheet into a recloseable cover over the packaged product.

4 Claims, 14 Drawing Figures

PACKAGING TECHNIQUES FOR SEMI-RIGID PACKAGES

This is a division, of application Ser. No. 860,590 filed Sept. 24, 1964 now U.S. Pat. No. 3,792,181.

This invention relates to the packaging of food products and the like in plastic containers. More particularly, this invention relates to (1) automatic apparatus for making packages from continuous webs of plastic sheet material, supplied in the form of roll stock, (2) packaging methods carried out by such apparatus, and (3) improved package constructions especially adapted to be formed by automatic apparatus.

For a number of years now, use has been made of various types of automatic apparatus for packaging food products. The automatic roll-stock machines have been particularly successful, and have gone into widespread use. Such machines, as shown for example in U.S. Pat. No. 3,061,984, are adapted to package products, such as sliced luncheon meat and frankfurters, in containers made from two continuous webs or sheets of thin flexible plastic film.

In such machines, one web is stretch-formed into the shape of a cup for the product, and the other web is applied in flat (unformed) state over the cup to serve as a top for the package. The top web is hermetically sealed to the cup periphery and the package interior evacuated. After evacuation is complete, atmospheric pressure forces both the top and bottom webs inwardly into tight fitting contact with the product, thus distorting both the container cup and its top into shapes conforming to the product profile.

An improvement on this type of package was made by substituting a heavy-gauge (10 mil PVC or heavier) plastic web for the formed flexible plastic web described above, thereby producing a semi-rigid container shell better adapted to retain its shape. A significant further improvement was made by stretch-forming the flexible top web in such a way as to prevent the top film from transmitting distorting stresses to the semi-rigid formed shell after evacuation, thus avoiding the tendency of such shells to be collapsed by atmospheric pressure. A discussion of this problem and suitable corrective techniques is set forth in co-pending Application Ser. No. 64,034, filed July 22, 1970, now U.S. Pat. No. 3,695,900, which is a continuation application of Ser. No. 484,249, filed on Sept. 1, 1965, now abandoned, by W. E. Young and R. A. Mahaffy.

As explained in that co-pending application, stretch-forming of the flexible top can be effected by preheating the top web in an operating station preceding the evacuation station, and forming the top web at the evacuation station, i.e. during the evacuation and vent cycle. Some of the advantages of a package made by using such techniques are: (1) The bottom surface of the package is smoother (less wrinkled) than in prior packages made entirely from flexible film, and thus the bottom of the package is adapted to serve as a display face for presenting the product to a customer; (2) the package can more readily be opened, since the packaging materials are more easily peeled apart; (3) the semi-rigid cup provides better storage of unused portions of the original contents; and (4) a group of such packages can readily be stacked since the face of one package nests within the recessed back of the next.

Although packages of the semi-rigid cup type have furnished very important benefits, it has been found that certain new features can provide important improvements. For example, as will be explaimed hereinafter, new techniques make it possible to hold a packaged product pressed against the display face when the package interior is not evacuated, a feature particularly useful in (1) gas-filled packages, (2) vacuum packages which have leaked a small amount, and (3) packages not hermetically sealed. These new techniques also provide a package having even greater overall rigidity than prior semi-rigid cup packages, and make it readily possible to display the product to a customer through the container top, rather than through the bottom of the cup.

The present invention provides a new type of package having these desirable characteristics, and yet capable of being produced by automatic packaging apparatus operating on continuous webs of plastic sheet supplied as roll stock.

These objectives, as well as other related advantages, have been achieved by packaging techniques in accordance with the present invention. In one preferred embodiment of this invention, to be described hereinbelow in detail, a package is produced having a semi-rigid cup-like container formed from a heavy-gauge plastic sheet (as in prior art packages) heated and formed by conventional vacuum and/or pressure means into a shell which approximates in configuration the profile of the products it is to contain. This shell is covered with a top made of semi-rigid material, rather than flexible film as in the prior art packages described above.

In accordance with one aspect of this invention, it has been determined that such a semi-rigid top can be formed by appropriate techniques from a continuous sheet of roll stock. Preferably, the material for the top has a thickness about the same as, or somewhat less than, that of the associated semi-rigid cup. The top is heat-sealed to the formed shell at least around most of its periphery. Interiorly of the heat-seal area the top also is heated to a plastic condition, and subsequently is forced downwardly towards the semi-rigid cup to conform at least roughly to the shape of the product previously placed in that cup. In one embodiment this downward forming of the plastic top advantageously is effected by atmospheric pressure when the exterior of the package is vented following evacuation. The forming of the heated top down against the product avoids the tendency of the semi-rigid shell to collapse during such venting.

A package constructed in this manner meets the objectives outlined above and, in addition, offers other important benefits in use. For example, when the package is peeled open, there is less chance of tearing the cover sheet. Also, this package lends itself in a unique fashion to special configurations providing a positive reclosure characteristic, i.e. an assured holding of the top in its closed position.

Accordingly, it is an object of this invention to provide improved packaging techniques, including novel means and methods for packaging items such as food products. A more specific object of the invention is to provide improved packages of the semi-rigid type having unique characteristics. Other specific objects of the invention include the creation of improved gas-filled packages, as well as packages having a superior reclosure capability. Still other objects, aspects and advantages of the invention will in part be pointed out in, and in part apparent from, the following description considered together with the accompanying drawings, in which:

Figure 1:
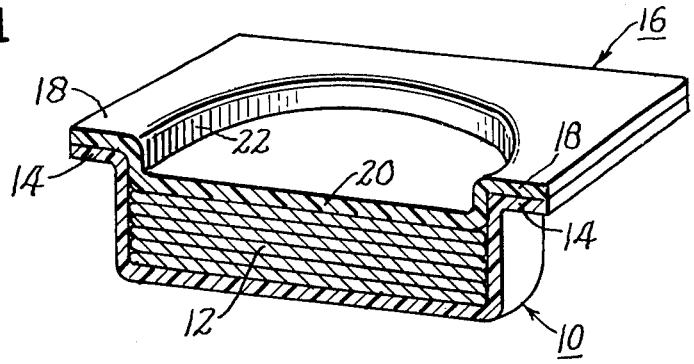
FIG. 1 is a perspective view, in section, of a package made in accordance with this invention and adapted for use with sliced luncheon meat.

Referring now to FIG. 1, there is shown in sectional perspective a package comprising a round receptacle cup 10 of heavy-gauge plastic. This cup contains product 12 having a circular outline with flat top and bottom surfaces, e.g. a stack of bologna or round luncheon meat. The cup is formed with marginal portions 14 in the plane of the cup mouth, and having a generally rectangular plan configuration. The product has a depth smaller than that of the cup, so that there is a moderate amount of space between the top of the product and the level of marginal portions 14.

The top 16 of the package includes outboard portions 18 with a rectangular plan configuration matching that of the marginal flanges 14 of the cup 10. These top portions 18 are heat-sealed to the cup flanges to hermetically seal the package interior from outside atmosphere thus providing for vacuum packaging. This top is formed of heavy-gauge plastic, providing form-retaining characteristics, and is shaped with a downwardly-offset central portion 20 telescoped within the container cup.

The walls 22 of this concave top 16 are tightly fitted within the cup walls and held pressed thereagainst. The central portion 20 similarly is pressed against the top surface of the product 12, thus advantageously holding the product tightly gripped between the top and bottom of the package. The form-retaining characteristics of the plastic material of both the cup and its top assures that this tight grip of the product will be maintained even without a pressure differential between the inside and the outside of the package.

The materials selected for the package must meet several criteria, some tending to conflict, thus making the selection relatively critical. For example, in order to obtain form-retaining capability, the packaging material must be relatively rigid. However, it must be capable of readily being formed at high speed into various complex shapes by means of heat and pressure. The material also should present a barrier to the passage of oxygen. The physical characteristics of the top material also should include the capability of being heat-sealed to itself, yet easily peeled apart for opening the package. And, as with all packages, the packaging material must be able to withstand the particular environments and handling conditions encountered in usage.

A packaging material which has been found to meet these exacting requirements is a laminate consisting of (1) a first outer layer of PVC with a thickness of 7½ mils for rigidity, (2) a thin intermediate layer (0.1 mils) of PVDC for oxygen barrier, and (3) a 2 mil inner layer of Surlyn (an ionomeric thermoplastic sold by Dupont) to provide heat sealing and peelable opening. This same material advantageously may be used for making both the semi-rigid cup and the top, although in some cases the gauges of the two webs may be somewhat different. The engaged (heat-sealed) layers of plastic are self-peelable, i.e. the two package components can be peeled apart without requiring stresses sufficient to destroy either component.

Figure 2:
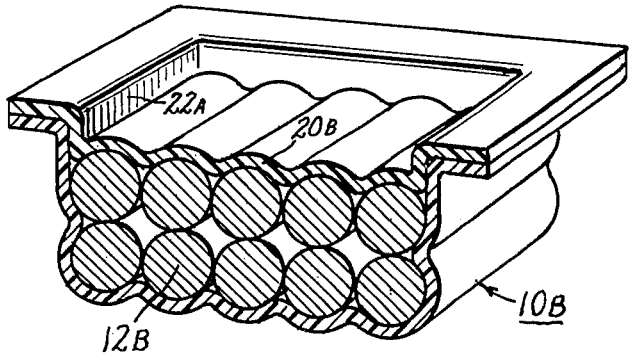
FIG. 2 is another package configuration, showing both the top and bottom webs shaped to fit about a group of frankfurters.

FIG. 2 shows a package in which the cup 10B has a generally rectangular plan outline, and is formed with a bottom and side wall configuration shaped to snugly receive two layers of frankfurters 12B. The central portion 20B of the top also has been formed to fit tightly about the curved upper surfaces of the frankfurters, so as to distribute the pressure load over a relatively broad area of the product.

Figure 3:
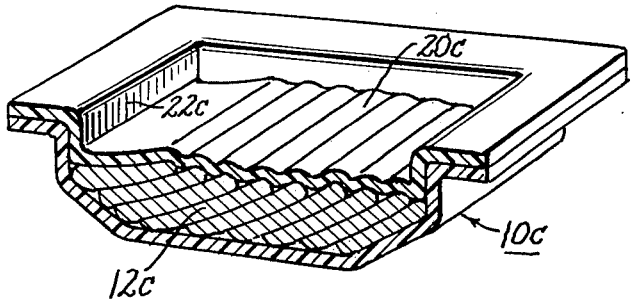
FIG. 3 is another package shaped for sliced bacon.

FIG. 3 shows another package wherein the cup 10C is specially shaped to receive sliced bacon 12C, and the top 20C is formed about the upper edges of the bacon slices, to hold the entire group of slices firmly in place with a broadly distributed pressure load.

The packages shown in FIGS. 1–3 can be evacuated and hermetically sealed, a feature of importance in obtaining extended self-life of many food products. After evacuation, the packages advantageously may be filled with an inert gas, at or somewhat below atmospheric pressure. In the gas-filled packages of FIGS. 1–3, the form-retaining characteristics of both the top and the receptacle cup assure that the product will be held tightly in position, i.e. immobilized in the package, pressed against the under surface of the top central portion 20. This holding pressure particularly enhances the display characteristics of the package, since many products contain liquids which "wet" the inner surfaces of the package in the areas of contact thus minimizing or eliminating voids and gas bubbles which detract from optimum appearance. This enhancement of appearance applies to both the top and the bottom of the cup.

Figure 4:
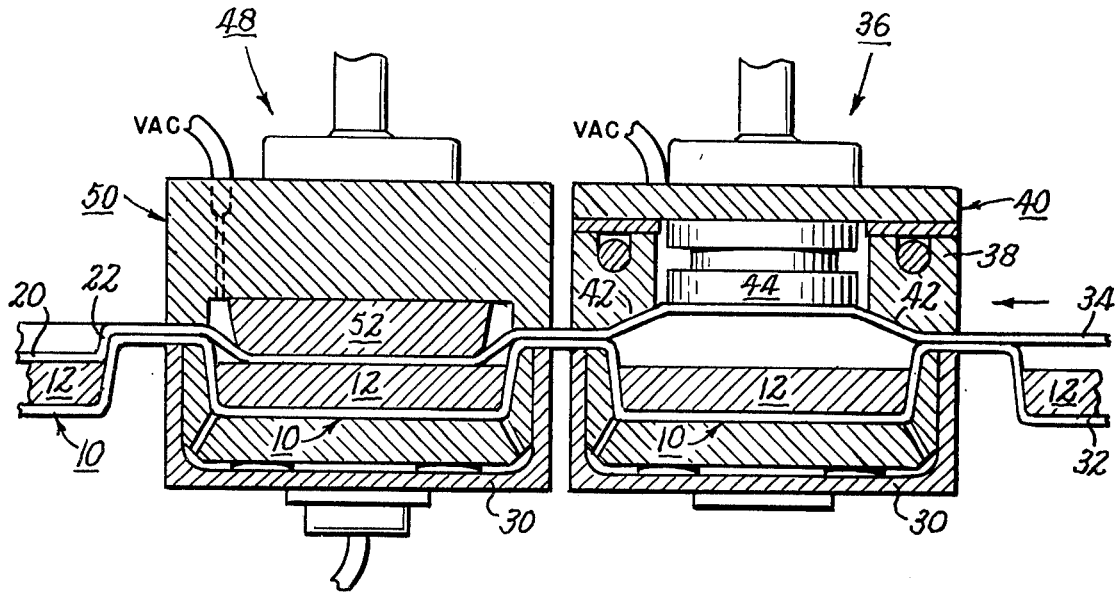
FIG. 4 is a vertical longitudinal section showing a portion of an automatic packaging machine adapted to make packages as shown in FIG. 1.

FIG. 4 shows the pertinent portion of an automatic packaging machine for producing packages of the type shown in FIG. 1. This machne is basically of the type shown in U.S. Pat. No. 3,061,984, comprising a series of tray-like dies 30 arranged for intermittent indexing movement around a closed path passing through or by a series of sequential operating stations. At one of these stations, the lower web 32 of semi-rigid plastic sheet is secured to the sides of each die in succession, and is formed by known heat and pressure techniques into the round cup shape of the die cavities. (Note: conventionally each die 30 has two side-by-side cavities to form two identical cups simultaneously, although only one cavity is shown in the drawings.) Subsequently, the upper semi-rigid plastic web 34 is applied over the formed cups and the die thereafter carries both webs into a preliminary sealing stage 36. In this stage, the top web is heat-sealed to the marginal portions of the formed cup, by the heat-seal bars 38 carried by the reciprocally-operated clamp 40, in the manner taught in U.S. Pat. No. 3,061,984.

The heated portions of this clamp 40 include inclined wall segments 42 which extend in a circular pattern above the side walls of each formed cup. During the preliminary sealing operation, the interior of the clamp is evacuated above the top web 34, to draw this web up into contact with the heated segments 42. Within the circular region bounded by the segments 42 are insulating discs 44 which are maintained at a low temperature relative to the surrounding segments. These discs engage the plastic web 34, limiting its upward movement so as to prevent undue stretching thereof by the applied vacuum, and to assure that the heat is restricted to the localized region of the web immediately above the walls of each cup 10.

Prior to the next indexing movement, the vacuum is vented from above the web 34, and the clamp 40 is lifted up away from the die 30. The die then is shifted to the final seal station 48 which includes a sealing head 50 mounted with clamp 40 for simultaneous reciprocating action. This sealing head is formed on its lower surface with a recess containing a pair of side-by-side plugs 52 aligned with the cavities in die 30. When the sealing head comes down into position against the die (as shown), these plugs stretch-form the heated top web 34 down into the cup 10 towards engagement with the product 12. The stretching of the top web is restricted primarily to the heated areas thereof, i.e. the circular bands immediately above the walls of the cup.

After the sealing head 50 has seated completely down against the die, the evacuation cycle is initiated. As described in U.S. Pat. No. 3,061,984, each die carries a reciprocable web-lifter (not shown herein) centrally located between the two side-by-side die cavities. This web-lifter is shifted up through an evacuation slit in the lower web 32 to lift the central part of the upper web 34 away from the lower web to form an evacuation channel into the interior of the cups. Vacuum then is applied to the region beneath the evacuation slit to exhaust substantially all of the air from the interior of both cups. This same vacuum is applied to the outer surfaces of the packages then in the die, to prevent any large differential pressure from being developed across the plastic sheet material.

To make gas-filled packages, the web-lifter preferably is constructed with an internal conduit (see U.S. Pat. No. 3,061,984) leading from a valved gas line up to the top of the web-lifter. After evacuation is complete, the gas line is valved open and gas flows into the interior of the cups through the channel established between the upper and lower webs 34 and 32. When the correct amount of gas pressure has been established, preferably somewhat below atmospheric, the gas line is valved off, and the web-lifter is shifted down to its normal position. Thereafter, a heated sealing bar descends from the sealing head 50 to heat-seal the upper web to the lower web at the evacuation slit, i.e. along the line between the two side-by-side cups. This heat seal, together with the peripheral seal made in the preceding station, completes the hermetic sealing of both packages in the die.

Just prior to the next indexing step, the interior of the sealing head 50 is vented to atmosphere. The resulting pressure on the still-heated top web 34 fully stretches this web down into each cup 10, forming the vertical top walls 22 which are pressed tightly against the side walls of the cup. Such further stretching of the top web is most effective when making vacuum packages, rather than gas-filled packages, because the maximum differential pressure will be developed across the plastic sheet material. In any event, the central portion 20 of the top is pressed against the product 12 so that, when the web 34 cools, this central portion will continue to hold the product gripped in position firmly against the bottom of the cup, without any significant distorting stresses being applied to the walls of the cup by the stretched top. It is advantageous, when carrying out the sequence of steps described, to maintain vacuum within the die 30, and below the cup 10, until after the space within the sealing head 50 is vented.

Figure 5:
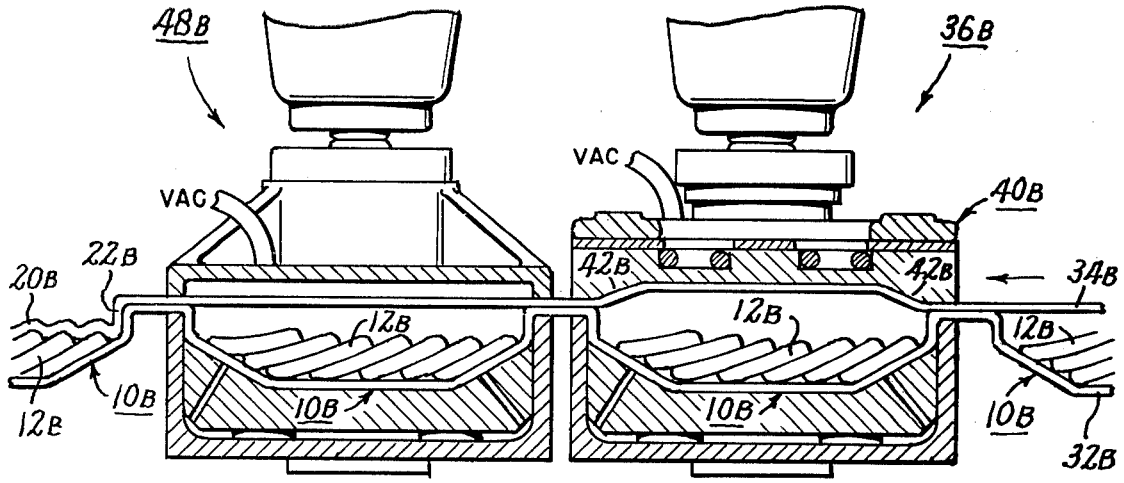
FIG. 5 is a vertical longitudinal section showing a portion of another automatic packaging machine suited for making packages as shown in FIG. 3.

For packaging products which do not have a flat upper surface, the top web must be formed to match the contour of the product. This can be accomplished, as shown in FIG. 5, by using in the preliminary seal station 36B a clamp 40B having heated segments 42B arranged to engage all of the top web 34B within the margins of the corresponding cup 10B. Thus the central portion of the top web is heated to forming temperature, as well as the side portions just inside the heat-seal line at the margins of the cup.

The evacuation and final seal stage 48B is generally like that of FIG. 4, except that there is no pre-forming plug. Instead, the entire forming function is effected by atmospheric pressure after venting. Since all of the top web was heated in the preceding stage, the atmospheric pressure forms the central top 20B to fit the contours of the product 12B as shown in the position immediately following the final seal stage 48B.

Figure 6:
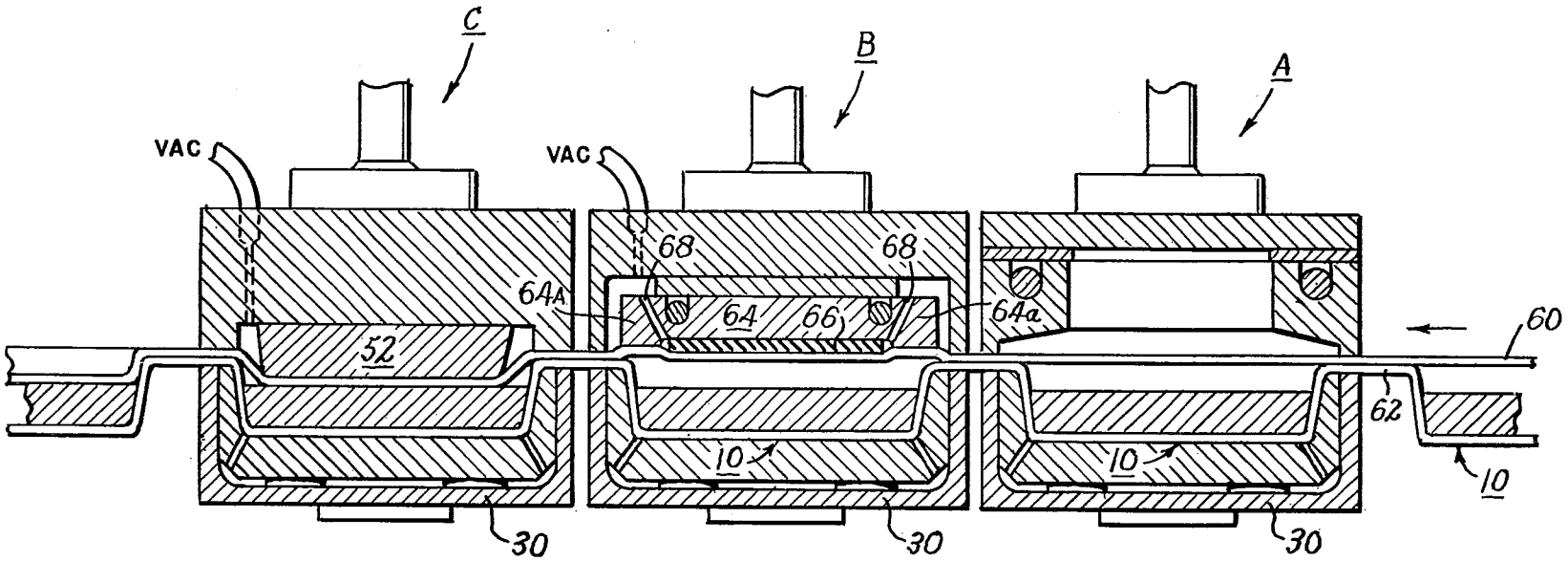
FIG. 6 is a vertical longitudinal section showing still another arrangement of packaging apparatus.

For some applications, e.g. where the stretch-forming of the top web is particularly difficult to achieve to the required degree, it may be desirable to use a three-stage top-forming arrangement as shown in FIG. 6. In this arrangement, the first stage A makes a preliminary seal of the two webs 60 and 62 entirely around the periphery of the two cups 10 in the die 30. Thus this stage is essentially like the preliminary seal stage in prior machines.

The next stage B, however, is provided solely for heating the top web 60 to its forming temperature, thereby ensuring close and precise control over this heating operation. As before, vacuum is applied above the top web to raise it up into contact with a heated element 64. For products having a flat upper surface (as shown in FIG. 6), only the peripheral regions of the top web should be heated. Thus an insulating disc 66 is provided to engage the central portions of the web, while the peripheral regions contact the hot outer band 64A beyond the vacuum conduits 68. For products having a non-flat top surface, the entire area of the top web must be heated to forming temperature.

The pre-heated top web then is moved to the evacuation and final seal stage C. In this stage, the heated web is forced down by pre-forming plug 52, and the final forming of the top is effected by atmospheric pressure, as described with respect to FIG. 4.

One of the important characteristics of packages in accordance with the present invention is the capability of providing positive reclosure. That is, after the package has been opened and a part of the product removed, the top can be reclosed and automatically held in place mechanically by positive gripping means. FIGS. 7–15 illustrate various package configurations with this feature.

Figure 7:
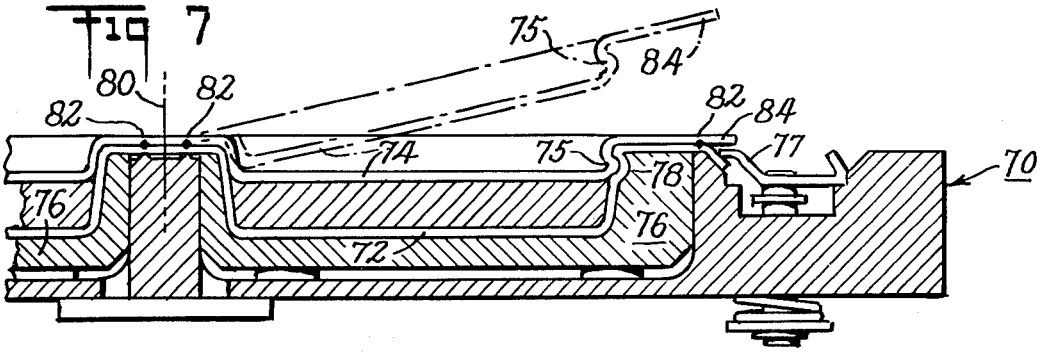
FIG. 7 is a vertical cross-section showing part of a packaging die having a special contour for setting the configuration of both the bottom and top webs.

FIG. 7 shows a forming die 70 of the type adapted for use with a packaging machine of the general type shown in U.S. Pat. No. 3,061,984. This die has two side-by-side cavities within which semi-rigid cups 72 may be formed and covered with a semi-rigid top 74 as described above. The die 70 includes recessed spring-loaded clamps 77 to grip the side margins of the bottom web, at taught in U.S. Pat. No. 3,438,175.

Each die cavity contains a die filler 76 the outboard wall of which is formed with a surface irregularity consisting, in this embodiment, of a horizontal groove-like re-entrant recess 78 just below the top surface of the die and extending nearly the full length of the wall. When the heated bottom web 72 is drawn into the die by vacuum, the plastic sheet material is pressed into this recess to form a mating groove in the inner side wall of the cup. Similarly, when the top web is subsequently stretch-formed into the cup (as described above), the plastic sheet material is forced into the cup groove to form a mating ridge 75.

After evacuation and final sealing, the two side-by-side packages in each die are separated at the center line 80, between the outer heat seals 82. Subsequently, the customer may open the package by lifting up the marginal outboard edge 84 of the top 74, to break the heat seal 82 along that one side, and along the adjoining sides perpendicular to that one side. The top will pivot (as shown in interrupted outline) about the heat-seal at the remaining side which thus will be the hinge side for the top. For some applications, the packaging apparatus may be arranged to score or thin the plastic sheet along the intended hinge line, as by striking the sheet with a heated bar, to enhance the hinge action.

After a portion of the product has been removed from the cup 72, the top 74 may be pivoted back down to its closed position. In that position, the ridge 75 re-enters the corresponding groove-like recess 78 in the cup wall, and serves as a detent to hold the top in place.

Figure 8:
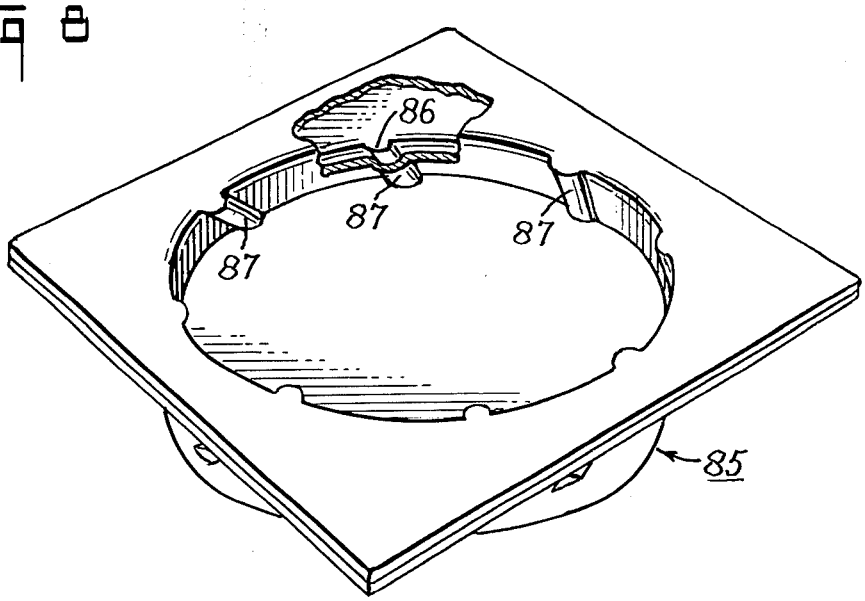
FIGS. 8 through 14 are views showing various package embodiments with positive reclosure characteristics.

An alternative detent arrangement for positive reclosure is shown in FIG 8. Here the side wall of a round cup 85 is formed on its inner surface with spaced angulated ridges 86. These ridges engage mating groove-like surfaces of correspondingly angulated elements 87 in the side wall of the top. Because ridges 86 and elements 87 are inclined at an angle to the vertical in the nature of a helical screw-thread configuration, the top may easily be removed by a twist-off movement. After the package has been opened, it may readily be reclosed by a reverse twisting action. The angles and lengths of the helical groove may be altered as required to set the desired degree of rotation for engaging and disengaging the top.

The package of FIG. 8 may be formed by a die like that of FIG. 7, but modified to provide the cavity walls (e.g. the side walls of a die filler) with protruding ridges similar in appearance to the top elements 87. Thus the heated bottom web will be formed about the die ridges to make the inwardly-extending ridges 86, and thereafter the heated top web will be formed about the ridges 86 to produce the mating groove-like recesses in the side wall of the top.

Figure 9:
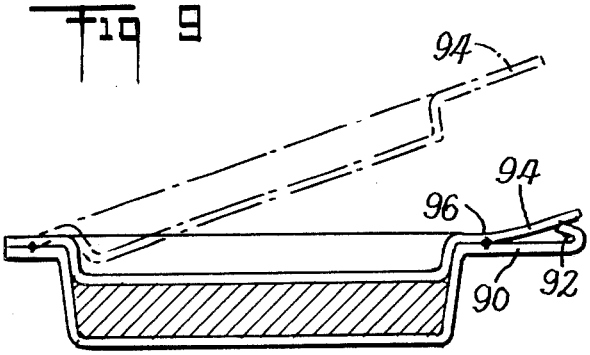

A positive reclosure can also be obtained by clip arrangements formed in the marginal areas of the top and bottom webs. Referring first to FIG. 9, the cup can be formed with an extended side margin 90, the end of which is permanently bent back on itself through approximately 180° to form a pocket 92. The top web is provided with a side margin 94 which extends out over the pocket 92, and is heat-sealed to the lower web at a position 96 close to the cup.

Figure 10:
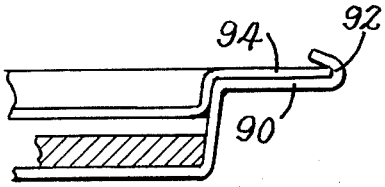

The package of FIG. 9 can readily be opened by peeling the top away from the cup, breaking the heat seal 96, as well as the heat seals along the sides of the cup which are perpendicular to the heat-seal 96. The top will pivot about the far side of the cup, as indicated in broken outline. The package thereafter can be reclosed by bowing the top slightly so as to slip the top margin 94 into the pocket 92, as shown in FIG. 10. It may be noted that the pocket 92 can readily be formed on automatic packaging machines by various known techniques, such as by applying a heated bar to the side margin 90 near the outside edge thereof, and then bending the edge up about the heated area by a reciprocable bar or the like.

Figure 11:
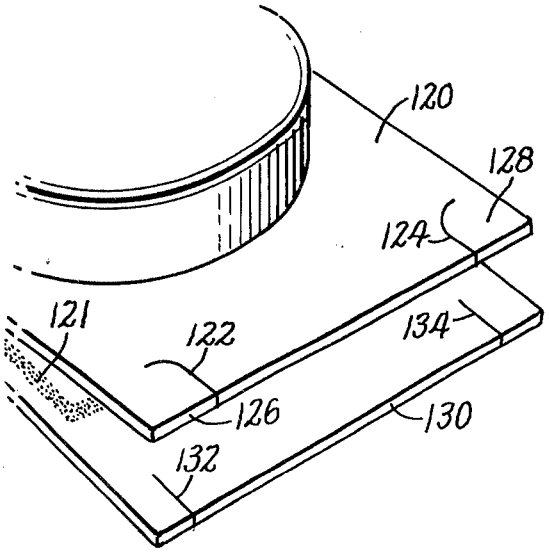
Figure 12:
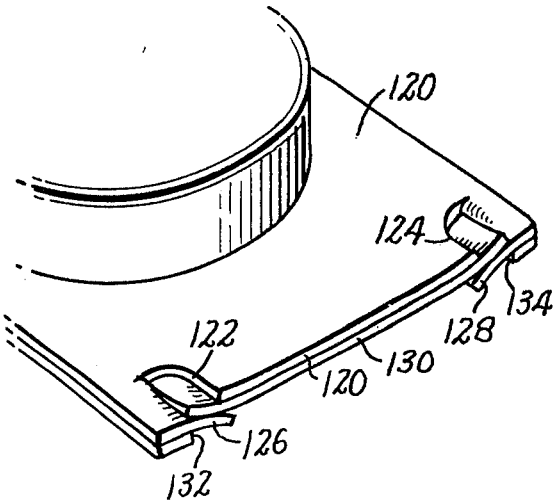

FIGS. 11 and 12 show another embodiment providing interference clips for positive reclosure. In this embodiment, the cup flange 120 is cut through in two places 122 and 124 to form the outlines of corresponding corner tabs 126 and 128. The adjacent marginal flange 130 of the package top is cut through in two places 132 and 134 to form straight slits just beneath the tabs 126 and 128. These lancing operations can conveniently be performed just prior to application of the respective web to the travelling die, as by means of automatic cutting tools immediately adjacent the packaging machine.

The package of FIG. 11 is completed and sealed in the usual fashion, described above. (Note: The cup and the top are shown spaced from one another in FIG. 11 only for illustrative purposes, and of course will be heat-sealed together around the cup mouth, as indicated by dotted line 121.) The package may be opened by peeling the two sealed flanges 120 and 130 apart, pivoting the top about the opposite side, i.e. the side not shown in the drawing. To close the package, the two flanges 120 and 130 are brought back together, and the tabs 126 and 128 pushed through the slits 132 and 134, as shown in FIG. 12. This can readily be done simply by bending the corners of the package downward.

Figure 13:
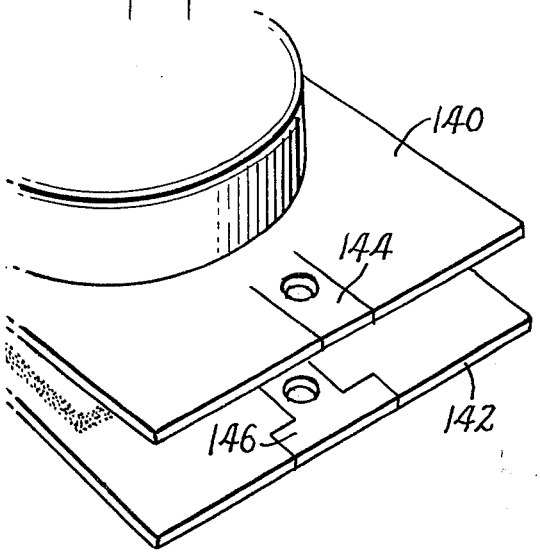
Figure 14:
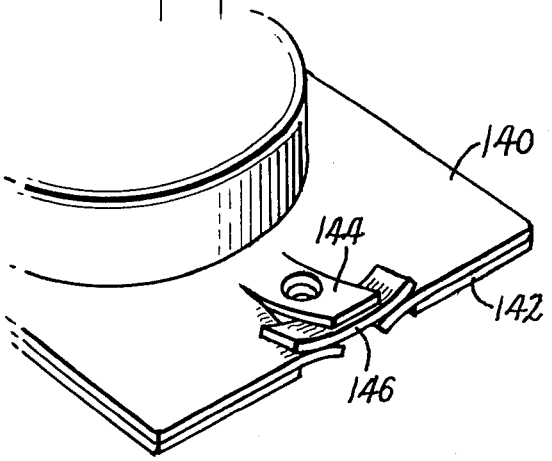

FIGS. 13 and 14 show a still further embodiment, where the cup and top flanges 140 and 142 are lanced to form the outlines of differently-shaped tabs 144 and 146. The package is otherwise formed and sealed in the usual way. After opening, by peeling the two flanges apart, the package may be reclosed positively by pushing the bottom tab 146 up through the side slits of the top tab 144. The natural resilience of the plastic material will accommodate this reclosure operation.

We claim:

1. The method of packaging products comprising:

stretch-forming a first sheet of semi-rigid plastic into a die cavity having a surface irregularity in the inner surface of at least one side wall thereof, said first sheet conforming to the side walls of said die cavity including the surface irregularity, thereby to develop a semi-rigid plastic receptacle cup with a side wall presenting a wall-surface irregularity corresponding to said die surface irregularity;

placing in said cup, while still in said die cavity, a product having its upper surface below said wall-surface irregularity;

applying a second sheet of semi-rigid plastic over said cup as a cover top for said cup while said cup remains in said die cavity; and stretch-forming said second sheet into said cup down towards said product and out towards the side walls of said cup above said product, the outwardly-formed portions of said second sheet being conformed to the side walls of said cup above the product including the portion of said side walls presenting said wall-surface irregularity, thereby to develop in the outwardly-formed portions of said top an irregularity matching said wall surface irregularity of said cup and adapted to cooperate therewith to provide positive reclosure after the package has been opened.

2. The method of claim 1, wherein said wall-surface irregularity is formed with a horizontal component providing a mechanical detent characteristic.

3. The method of claim 2, wherein said irregularity in said first sheet is formed as a recess in the inner surface of said cup.

4. The method of claim 2, wherein said first sheet is formed into a cup circular in plan outline and wherein the irregularity is formed with at least one element extending in an angulated fashion both downwardly and around the side wall of the cup.

* * * * *